US005878924A

United States Patent [19]

Johnson

[11] Patent Number: 5,878,924

[45] Date of Patent: Mar. 9, 1999

[54] PLUNGER—ACTUATED CHEMICAL DISPENSE HEAD

[75] Inventor: Kenneth A. Johnson, Stockton, Calif.

[73] Assignee: Chemand Corporation, San Jose, Calif.

[21] Appl. No.: 901,748

[22] Filed: Jul. 28, 1997

[51] Int. Cl.[6] ..... B22D 37/00

[52] U.S. Cl. ..... 222/509; 137/614.05; 137/614.06; 251/149.9

[58] Field of Search ..... 222/504, 505, 222/509, 400.7; 137/614.05, 614.06; 251/149.9; 7/138

[56] References Cited

U.S. PATENT DOCUMENTS 5,108,015 4/1992 Rauworth et al. ..... 222/400.7
5,129,423 7/1992 Fournier et al. ..... 137/614.05
5,228,597 7/1993 Low ..... 222/504 X
5,546,986 8/1996 Clark II, et al. ..... 137/614.05

*Primary Examiner*—Gregory L. Huson
*Attorney, Agent, or Firm*—Larry E. Henneman, Jr.; Oppenheimer, Wolff & Donnelly, LLP

[57] ABSTRACT

A dispense head assembly includes a bung adapter, a body receiver, and a dispensing body. The bung adapter inserts into a drum. The body receiver selectively inserts into the bung adapter, and the dispensing body selectively inserts into the body receiver. A single, unobstructed, uniform-diameter flowpath routes fluid from the drum into a chamber within the body receiver. A movable piston within the chamber selectively blocks fluid flow between the fluid flowpath and a dispense opening on the dispensing body. The body receiver and the dispensing body are key matched, for safe and rapid coupling and decoupling.

16 Claims, 9 Drawing Sheets

110

PLUNGER— ACTUATED CHEMICAL DISPENSE HEAD

BACKGROUND OF THE INVENTION

1.1 Field of the Invention

The present invention relates generally to chemical distribution systems, and more particularly to chemical dispensing apparatus. Still more particularly, the present invention is a chemical dispense head assembly designed to maximize safety, chemical throughput, and ease-of-use.

1.2 Description of the Background Art

In many chemical distribution systems, a drum or tank serves as a chemical source or reservoir. A dispense head assembly that mounts to the drum, such as that described in U.S. Pat. No. 5,108,015, selectively controls fluid flow between the drum and chemical distribution piping. Semiconductor manufacturing environments provide well-known examples in which chemical distribution is accomplished in this manner.

A dispense head assembly design should satisfy several requirements. A first requirement is the maximization of chemical throughput, which may be especially critical in manufacturing environments. Prior art dispense head assembly designs, however, include flowpath obstructions and/or small-diameter flowpaths that undesirably limit the chemical flow rate.

A second requirement is simple, rapid coupling to and decoupling from the drum. Unfortunately, typical prior art dispense head assemblies must be completely screwed into or screwed out of the drum each time the dispense head assembly is coupled to or decoupled from the drum, respectively.

Another requirement is the maximization of safety, particularly when dealing with hazardous chemicals. This in turn requires that the dispense head assembly be key-coded, plus leakproof when coupled to the drum, as well as essentially dripless when decoupled from the drum. Unfortunately, the safety performance of some prior art dispense head assemblies has been known to degrade over time.

What is needed is a dispense head assembly that couples to a drum in a simple manner and safely provides high fluid flow rates through a large, essentially unobstructed flowpath.

SUMMARY OF THE INVENTION

The present invention is a dispense head assembly comprising a bung adapter, a body receiver, a wrench safety handle, a dispensing body, a cap, a spring-based plunger unit, and a lever-lock handle. The bung adapter provides an interface to a drum, and comprises a platform having a central opening that runs through a threaded neck. The threaded neck facilitates screw insertion of the bung adapter into the drum, and the central opening provides a fluid flowpath interface to the drum. The body receiver comprises a fin spring, and a fluid transfer tube that leads into a keyed tray. Via the fin spring, the body receiver snap-locks into the bung adapter, such that the fluid transfer tube interfaces with the bung adapter's central opening. The wrench safety handle comprises a wrench body that fits the exterior of the body receiver; and a wrench handle.

The dispensing body comprises a keyed base; and a cylinder having 1) a throat; 2) a chamber with a dispense opening; and 3) and a shelf separating the chamber and the throat. The dispense opening is preferably proximate to the shelf. The keyed base facilitates insertion of the dispensing body into the body receiver's keyed tray. The throat couples to the body receiver's fluid transfer tube, such that fluid flow can occur between the drum and the chamber's dispense opening.

The spring-based plunger unit comprises a piston body, an actuator rod coupled to the piston body, and a spring. The spring-based plunger unit resides within the chamber. The cap comprises a lid that screws onto the dispensing body at one end of the chamber. Screwing the cap onto the dispensing body compresses the spring, which in turn forces the piston body onto the shelf. When the piston body is against the shelf, the dispense opening and the throat are blocked, and the dispense head assembly is in a no-flow or "fully-off" state.

The cap includes a central opening, such that the actuator rod protrudes through the top of the cap. The actuator rod is coupled to the dispense head assembly's lever-lock handle. The wrench handle braces or supports the lever lock handle, such that lowering the lever-lock handle raises the actuator rod, which in turn further compresses the spring and thus raises the piston body off of the shelf. Once the piston body is raised past the dispense opening, the dispense head assembly is in a "fully-on" state in which maximum fluid flow can occur. The lever-lock handle snap-locks into a slot within the wrench handle to maintain the piston body's position in the fully-on state.

The present invention preferably employs o-ring seals to ensure leakproof interfaces between elements. The fluid flowpath between the drum and the dispense opening is unobstructed when the dispense head assembly is in the fully-on state. Moreover, the minimum flowpath diameter is equal to that of the bung adapter's central opening, and thus there are no flowpath constrictions or size reductions between the drum and the dispense opening.

DETAILED DESCRIPTION OF THE PREFERRED EMBODIMENTS

Figure 1:
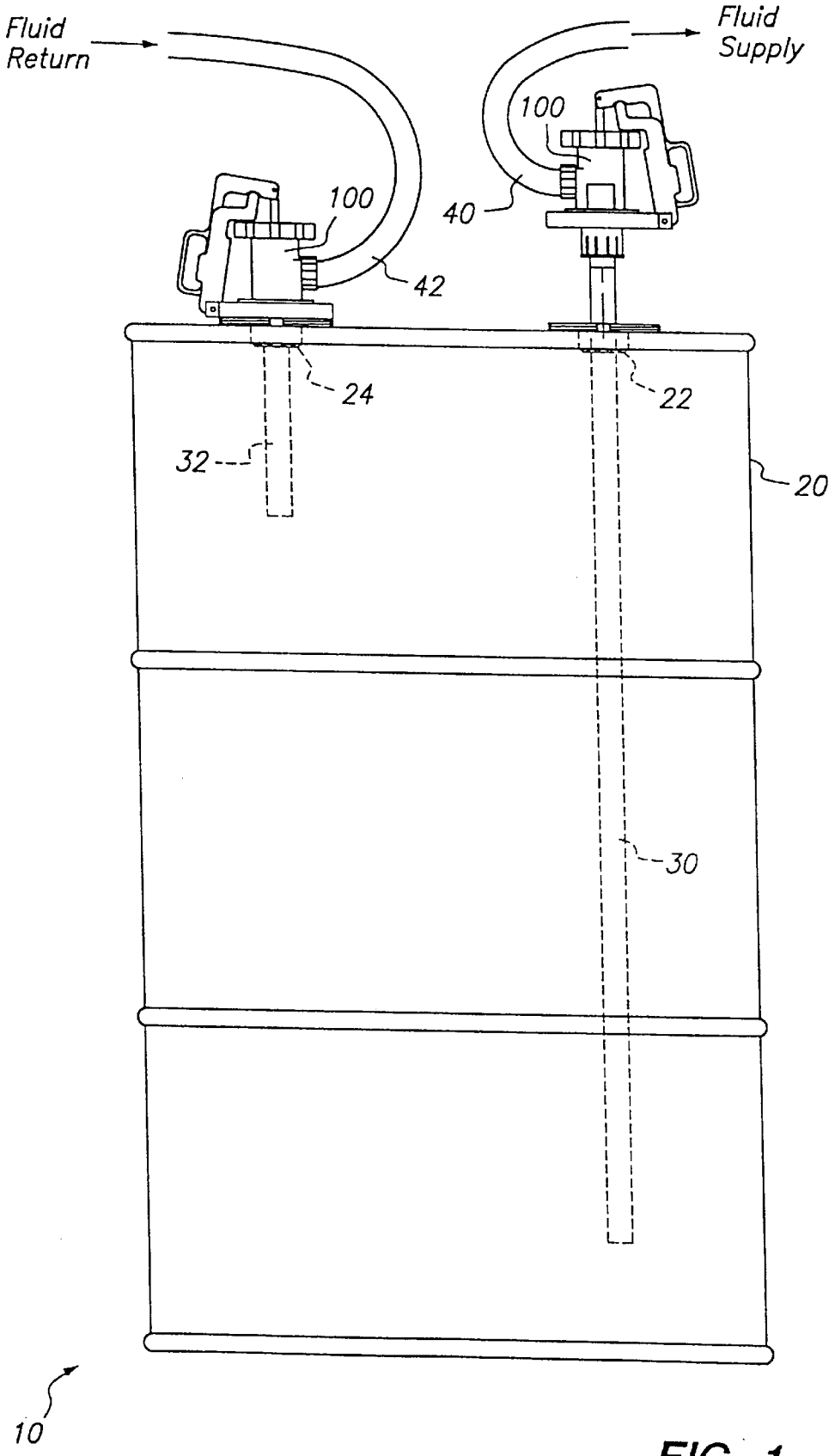
FIG. 1 is a side view of a preferred chemical distribution environment employing the present invention.

Referring now to FIG. 1, a side view of a preferred chemical distribution environment 10 employing the present invention is shown. In the chemical distribution environment 10, a drum or tank 20 serves as a chemical source or reservoir. Preferably, the drum 20 is a conventional standardized container rated for a particular type of chemistry, such as a 55-gallon polyethylene drum commonly utilized in the semiconductor industry for holding acids. The drum 20 preferably includes a first and a second bung interface 22, 24, each of which comprises a conventional threaded receptacle, such as that found on Fluroware drum model no. CNH1D556 (Fluroware Corporation, Chaska, Minn.). A first dispense head assembly 100 is attached to a sump dip tube 30 and mated with the first bung interface 22 to form a supply dispense head. Similarly, a second dispense head assembly 100, in conjunction with a return dip tube 32, mates with the second bung interface 24 to form a return dispense head. Those skilled in the art will readily understand that fluid is extracted from the drum 20 and delivered to a supply distribution pathway 40 via the supply dispense head, and returned to the drum 20 from a return distribution pathway 42 via the return dispense head. Preferably, each of the supply and return distribution pathways 40, 42 comprise conventional piping.

Figure 2:
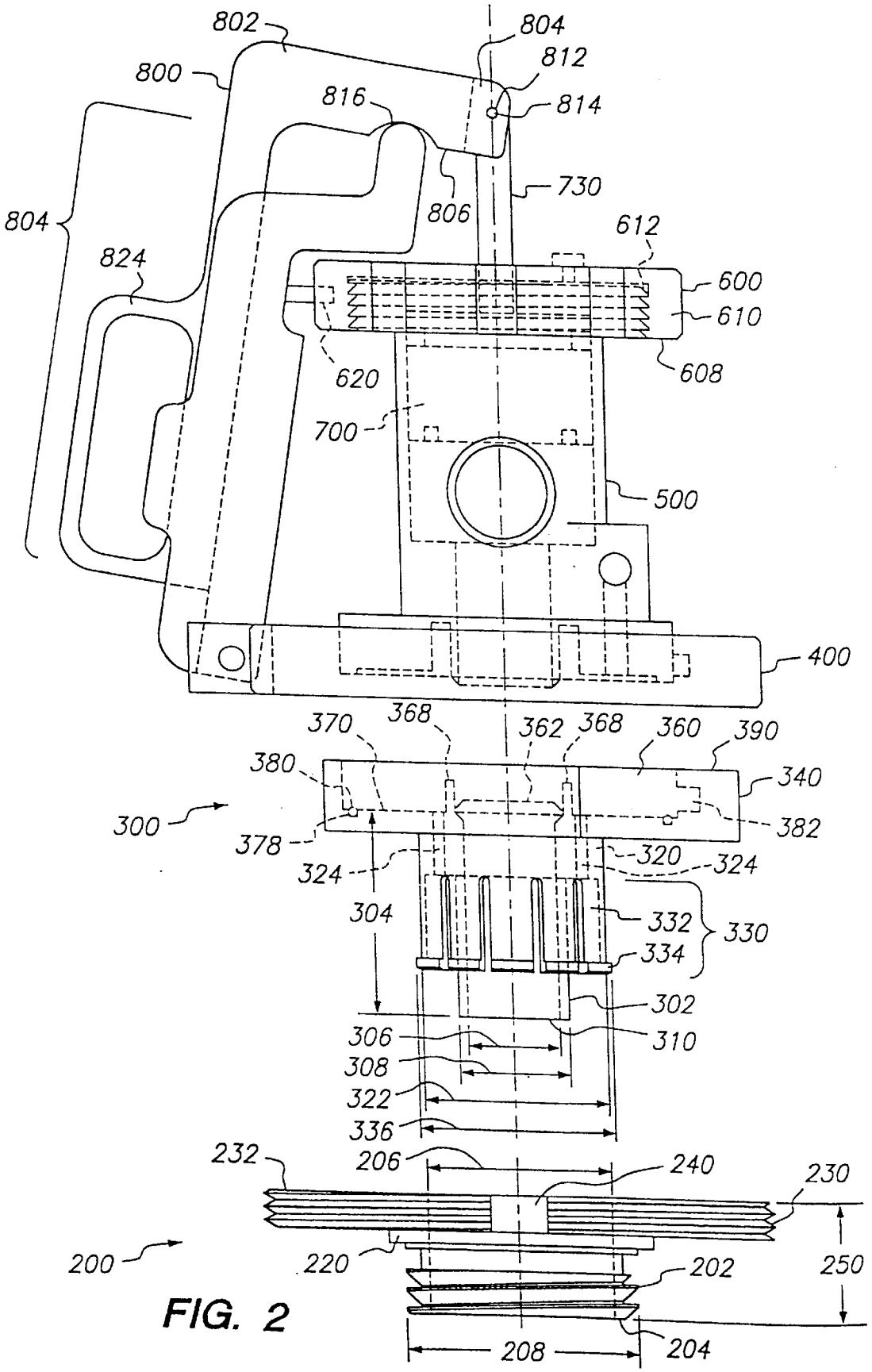
FIG. 2 is a cross-sectional view of a preferred embodiment of a dispense head assembly constructed in accordance with the present invention.

Referring now to FIG. 2, a cross-sectional view of a preferred embodiment of a dispense head assembly 100 constructed in accordance with the present invention is shown. The dispense head assembly 100 comprises a bung adapter 200, a body receiver 300, a wrench safety handle 400, a dispensing body 500, a cap 600, a spring-based plunger unit 700, and a lever-lock handle 800. Each element of the present invention is described in detail in the description that follows.

Bung Adapter

Figure 3:
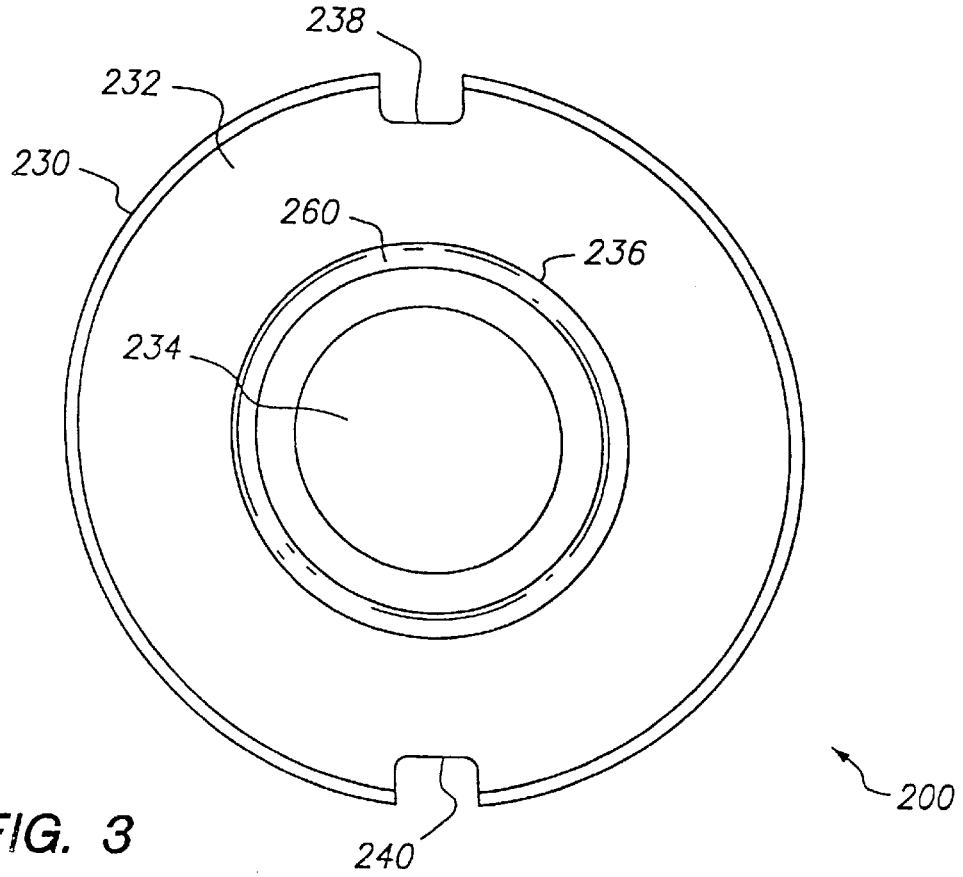
FIG. 3 is a top view of a preferred embodiment of a bung adapter of the present invention.

The bung adapter 200 couples the dispense head assembly 100 to the drum 20. Referring also now to FIG. 3, in which a top perspective view of a preferred embodiment of the bung adapter 200 is shown, the bung adapter 200 comprises a threaded neck 202 having a lip or rim 204, an inner diameter 206, and an outer diameter 208; a tiered neck collar 220; and a threaded platform 230 having a top surface 232, a central opening 234, an o-ring groove 236 concentric with the central opening 234, and a set of notches 238, 240. The distance between the threaded platform's top surface 232 and the lip 204 on the threaded neck 202 defines a bung adapter height 250.

Preferably, the threads upon the threaded neck 202 and the threaded platform 230 are supportive buttress threads. The notches 238, 240 provide gripping points for screwing the threaded neck 202 into one of the drum's bung interfaces 22, 24. Those skilled in the art will readily understand that the bung adapter 200 can be screwed into the drum 20 either manually or via robotic equipment (not shown). Those skilled in the art will also recognize that a different number of notches 238, 240 could be present in an alternate embodiment. The tiered neck collar 220 limits the extent to which the bung adapter 200 can be screwed into the drum 20.

The central opening 234 is preferably equal in size to the threaded neck's inner diameter 206, and thus the threaded neck 202 and the central opening 234 form a single tubular pathway through the bung adapter 200. The central opening 234 serves to facilitate insertion of the body receiver 300 into the bung adapter 200, and an o-ring 260 resting within the threaded platform's o-ring groove 236 ensures a leakproof seal between the bung adapter 200 and the body receiver 300.

Body Receiver

Figure 4:
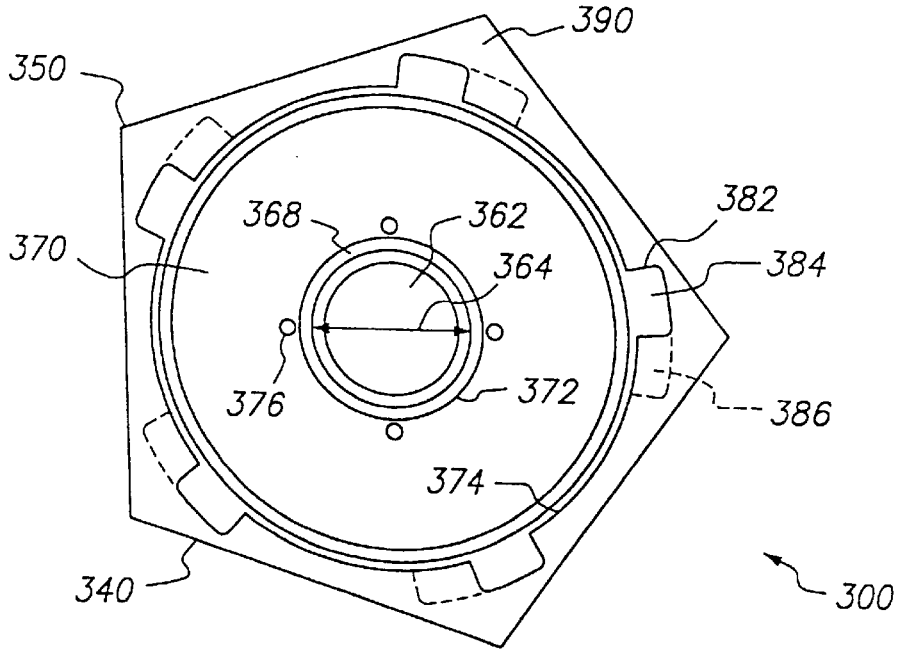
FIG. 4 is a top view of a preferred embodiment of a body receiver of the present invention.

Referring also now to FIG. 4, a top perspective view of a preferred embodiment of the body receiver 300 is shown. The body receiver 300 comprises a fluid transfer tube 302 having a length 304, an inner diameter 306, an outer diameter 308, and a connection end 310; a tube collar 320 from which a fin spring 330 extends, where the tube collar 320 and the fin spring 330 share a common first outer diameter 322; and a body pedestal 340 having a recessed coupling tray 360. The body receiver 300 is designed for interlocking insertion into the bung adapter 200, in a manner described in detail below. Once the body receiver 300 has been inserted into the bung adapter 200, the fluid transfer tube 302 provides a fluid flow pathway between the dispense head assembly 100 and the drum 20. The connection end 310 of the fluid transfer tube 302 is preferably welded to a dip tube 30, 32 before the body receiver 300 is inserted into the bung adapter 200.

The tube collar 320 comprises a disk of material residing directly beneath the body pedestal 340 that integrally surrounds the fluid transfer tube 302 over a portion of the fluid transfer tube's length 304. A set of gas pathways 324 form hollow tunnels extending from the recessed coupling tray 360 through the tube collar 320. Each gas pathway 324 provides a channel for routing a blanket gas such as Nitrogen from the dispense body 500 into the drum 20 as further described below, such that a given pressure can be maintained within the drum 20.

The fin spring 330 comprises a series of fins or blades 332 that extend from the tube collar 320 toward the fluid transfer tube's connection end 310. In the preferred embodiment, the fluid transfer tube 302 extends beyond the extent of fin spring's blades 332, to facilitate ease of welding between the fluid transfer tube 302 and a dip tube 30, 32. Each blade 332 includes a foot member 334 that protrudes beyond the first outer diameter 322. The blades' foot members 334 thus define a second outer diameter 336 that is greater than the first outer diameter 322. The fin spring 330 is essentially a cylindrical structure in which slits cut parallel to the fluid transfer tube's length 304 at predetermined intervals around the fin spring's perimeter define the blades 332. Each blade can be slightly deflected toward the fluid transfer tube 302 in a resilient, springlike manner.

In the preferred embodiment, the first outer diameter 322 of the tube collar 320 and the fin spring 330 matches the size of the bung adapter's central opening 234. The second outer diameter 336 defined by the foot members 334 protruding from the blades 332 is larger than the central opening 234. Via compression of the blades 332 toward the fluid transfer tube 302, the foot members 334 can be inserted into the bung adapter's central opening 234. The body receiver 300 can then be inserted into the bung adapter 200, sliding into the central opening 234 and the threaded neck 202.

In the present invention, the distance between the point at which the tube collar 320 meets the body pedestal 340 and the point at which a foot member 334 protrudes from a blade 332 defines an insertion length 336. The insertion length 336 is preferably equal to the bung adapter's height 250 plus slightly less than one-half of the diameter of the o-ring 260 that resides within the threaded platform's o-ring groove 236. Thus, once the foot members 334 exit the threaded neck 202, the blades 332 essentially immediately spring outward, causing the foot members 334 to interlock with the threaded neck's lip 204. The body receiver 300 thus vertically locks into the bung adapter 200, such that the body pedestal 340 is compressed against the o-ring 260 on the bung adapter's threaded platform 230, thereby forming a leakproof seal. In the preferred embodiment, the body receiver 300 maintains freedom of rotational motion while it is vertically locked into the bung adapter 200.

The body pedestal 340 preferably includes a top portion 390, as well as five corners 350 that define a pentagon. The body pedestal 340 is shape-matched to the wrench safety handle 400, as described in detail below. The recessed coupling tray 360 comprises a machined and/or molded region within the body pedestal's interior having structures that facilitate selective interlocking and leakproof insertion of the dispensing body 500. In the preferred embodiment, the recessed coupling tray 360 comprises a chamfered central opening 362, a seating collar 368, a floor region 370, an o-ring groove 378 in which an o-ring 380 resides, and a series of keyed slots 382. The chamfered central opening 362 comprises one end of the fluid transfer tube 302, and thus the chamfered central opening's inner diameter is given by the fluid transfer tube's inner diameter 306. The chamfered central opening 362 additionally has an outer diameter 364, at which distance the seating collar 368 preferably begins. The seating collar 368 comprises a raised hollow cylinder that is concentric with chamfered central opening 362. The floor region 370 extends from a first perimeter 372 adjacent to the seating collar 366 to a second past which the past which the keyed slots 382 reside. A series of openings 376 through the floor region 370 define the tube collar's gas pathways 324. Additionally, the o-ring groove 378 resides within the floor region 370, proximate the second perimeter 372.

The keyed slots 382 preferably comprise openings within the body pedestal 340 that are parallel to the floor region 370. A first portion 384 of each keyed slot 382 is open from the floor region 370 to the body pedestal's top portion 390, for vertically receiving a corresponding key member 530 on the dispensing body 500, as described below. A second portion 386 of each keyed slot 382 is vertically blocked, for preventing vertical motion of the dispensing head 500 after its insertion into the body pedestal 340, in accordance with conventional keying techniques. In the preferred embodiment, a keyed slot 382 resides at each of the body pedestal's five corners 350.

Wrench Safety Handle

Figure 5:
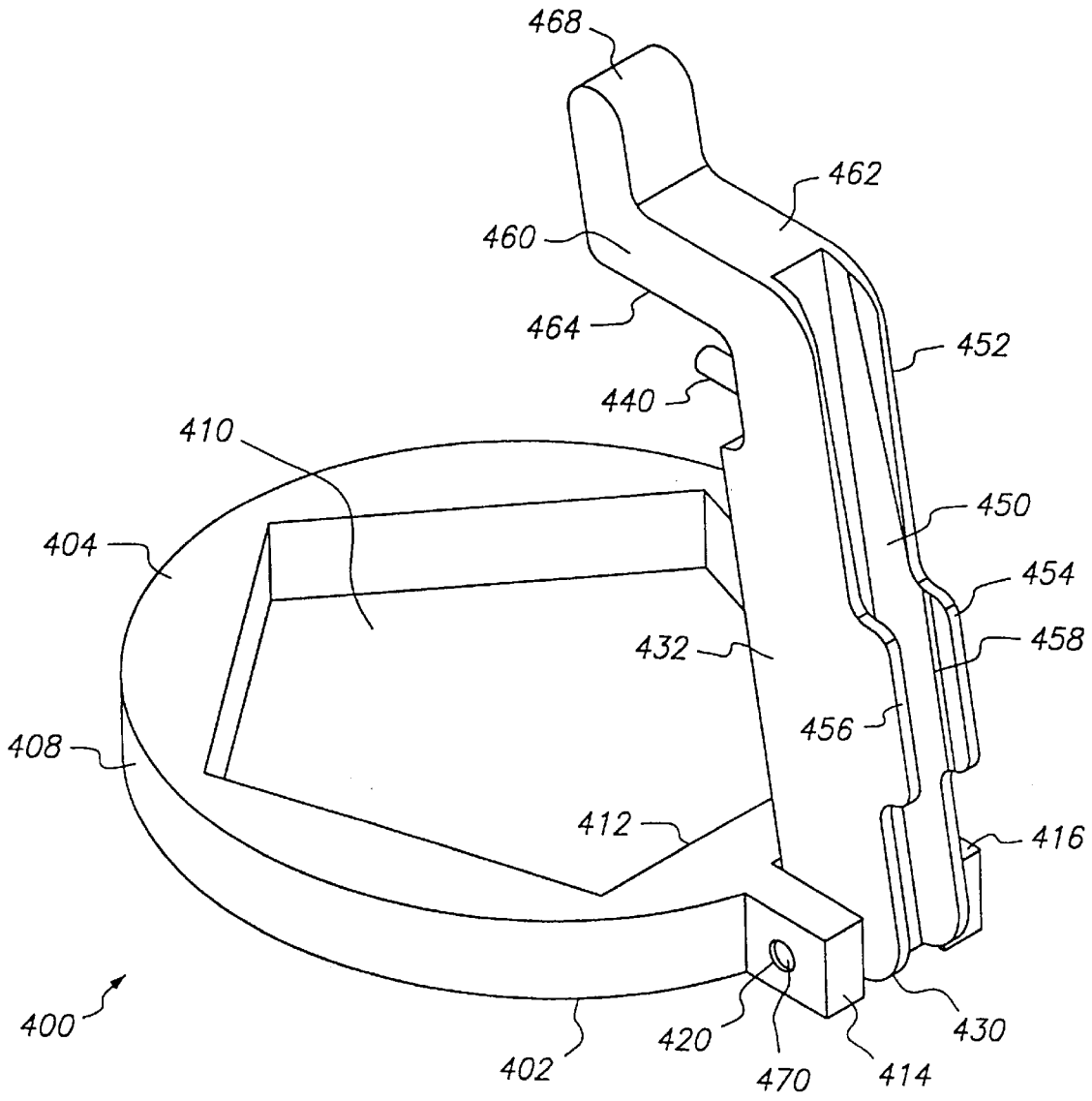
FIG. 5 is a rear perspective view of a preferred embodiment of a wrench safety handle of the present invention.

In the present invention, the body pedestal 340 and the wrench safety handle 400 are shapematched. Referring also now to FIG. 5, a top perspective view of a preferred embodiment of the wrench safety handle 400 is shown. The wrench safety handle 400 comprises a wrench head 402; a wrench handle 430; and a hinge pin 470. The wrench head 402 preferably comprises a top surface 404; a bottom surface 406; a generally circular exterior 408; a geometric opening 410 having a reference edge 412 and designed to receive the body pedestal 340; and a first and a second hinge post 414, 416. In the preferred embodiment, the body pedestal 340 and the geometric opening 410 are pentagonal. The present invention is typically utilized in a hazardous chemical environment. The use of a non-standard shape outline such as a pentagon helps to enhance safety by ensuring that components are used only in conjunction with tools for which they are designed, rather than conventional (i.e., hexagonal) tools.

Each of the first and second hinge posts 414, 416 protrude from the exterior 408 of the wrench head 402, preferably perpendicular to the geometric opening's reference edge 412. The first and second hinge posts 414, 416 each include an opening 420 for receiving the hinge pin 460. Additionally, the hinge posts 414, 416 are separated such that the wrench handle 430 can fit between them, with only slight side-to-side play.

The wrench handle 430 preferably comprises a main arm 432 having a hinge pin opening; a lock pin 440; a recessed slot 450 along a rear side 452 of the wrench handle 430; and a first and a second slot guide 454, 456, each of which has a lock lip 458. The wrench handle 430 further comprises a generally L-shaped secondary arm 460 having a top or receiving side 462, an underside 464, and a support stub 466 that has a curved end 468. The hinge pin 470 couples the wrench handle 430 to the first and second hinge posts 414, 416 via the hinge pin opening. Through hinging action, the wrench handle 430 can be placed in a position that is generally parallel with the wrench head 402, or a position that is generally perpendicular to the wrench head 402. While in the generally parallel position, the wrench handle 430 can readily turn or rotate the wrench head 402. While in the generally perpendicular position, the lever-lock handle 800 can selectively interlock with the wrench handle 430 to effect fluid dispensing in the manner described below.

The lock pin 440 comprises a cylindrical member that protrudes from the wrench handle's main arm 432, and is positioned parallel to and slightly below the underside 464 of the L-shaped secondary arm 460. The lock pin 440 facilitates interlocking between the wrench handle 430 and a lock opening 620 within the cap 600 when the wrench handle 430 is positioned perpendicular to the wrench head 402, as described in detail below.

The recessed slot 450 comprises a channel or groove within the wrench handle 430 that preferably begins at the receiving side 462 of the L-shaped secondary arm 460, and extends a length sufficient to receive the lever-lock handle 800, as described below. Each slot guide 454, 456 comprises a outward extension of a portion of the recessed slot 450. In the preferred embodiment, the recessed slot 450 and the slot guides 454, 456 have a width slightly larger than that of the lever-lock handle 800. The lock lip 458 on each slot guide 454, 456 comprises a raised or protruding region, such that the distance between the lock lips 458 is slightly less than the width of the lever-lock handle 800. The slot guides 454, 456 are preferably flexible to the extent that the lever-lock handle 800 can be forced through the lock lips 458 with moderate pressure, thereby locking the lever-lock handle 800 into the wrench handle 430 in the manner further described below.

Dispensing Body

Figure 6A:
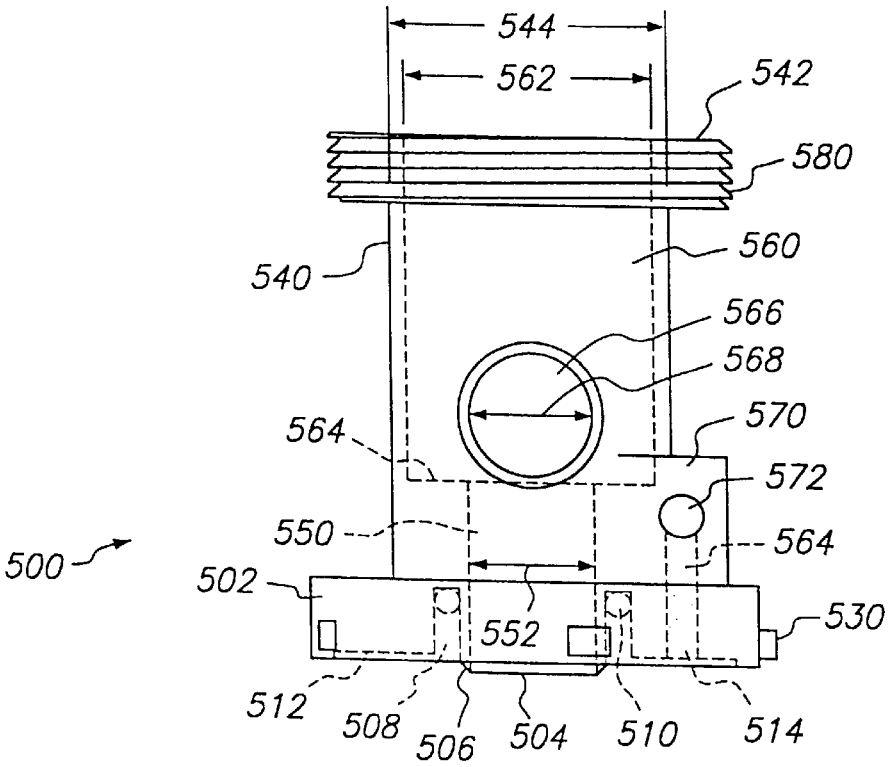
FIG. 6A is a cross-sectional view of a preferred embodiment of a dispensing body of the present invention.
Figure 6B:
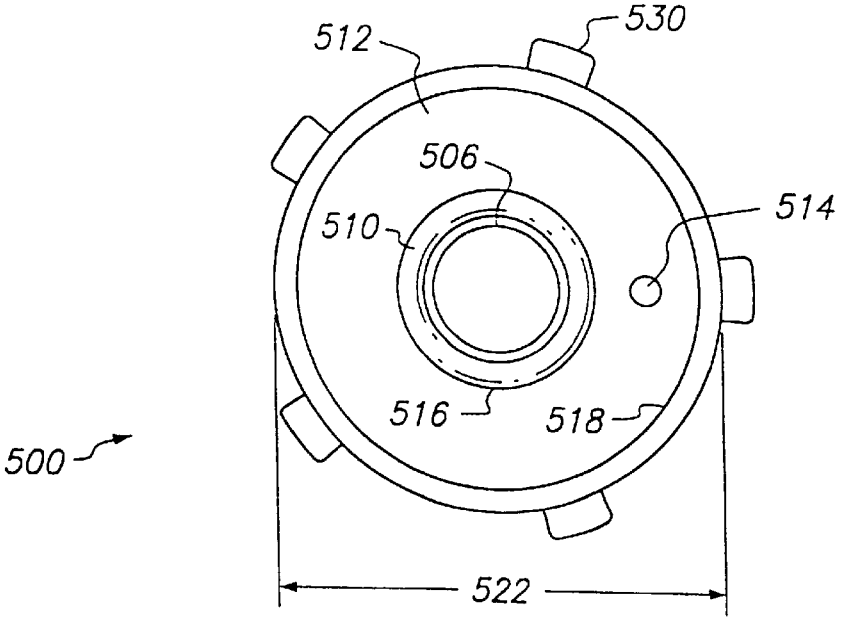
FIG. 6B is a bottom view of a preferred embodiment of the dispensing body of the present invention.

Referring also now to FIGS. 6A and 6B, a cross-sectional view and a bottom view of a preferred embodiment of the dispensing body 500 are respectively shown. The dispensing body 500 preferably comprises a base 502, a housing 540 and a threaded rim 580. The base 502 is designed to selectively interlock with the body receiver's recessed coupling tray 360, and comprises a central opening 504, a chamfered neck 506, an o-ring slot 508 in which an o-ring 510 resides, a ceiling region 512, a seat ring 520 having an outer diameter 522, and a series of key members 530. In the preferred embodiment, the central opening 504 has an inner diameter equal to the inner diameter 306 of the body receiver's fluid transfer tube 302. The chamfered neck 506 comprises a protruding ring concentric with and surrounding the central opening 504. In the preferred embodiment, the chamfered neck 506 is designed to fit inside the recessed coupling tray's seating collar 368, and is chamfered to mate with the recessed coupling tray's chamfered central opening 362. The o-ring 510 preferably surrounds the chamfered neck 506. When the dispensing body 500 is inserted into the recessed coupling tray 360, the coupling tray's seating collar 368 preferably abuts and compresses the o-ring 510 within the o-ring slot 508, thereby forming a leakproof seal between the seating collar 368 and the dispensing body's chamfered neck 506.

The ceiling region 512 includes an opening 514 through which a blanket gas is delivered from a hollow pathway 564 within the housing 540 in the manner described below. The dispensing body's ceiling region 512 extends from an inner perimeter 516 adjacent to the o-ring slot 508 to an outer perimeter 518 adjacent to the seat ring 520. In the preferred embodiment, the outer diameter 522 of the seat ring 520 is slightly less than the second perimeter 374 of the floor region 370 within the recessed coupling tray 360, such that a leakproof seal is formed between the seat ring 520 and the o-ring 380 within the recessed coupling tray 360 when the dispensing body 500 is inserted into the body receiver 300.

Each key member 530 protrudes from the base 502, and is designed to mate with or fit inside a keyed slot 382 on the recessed coupling tray 360. Insertion of the dispensing body 500 into the recessed coupling tray 360 is accomplished by aligning each key member 530 with the first or vertically open portion 384 of a keyed slot 382. The dispensing body 500 is then rotated into a key-locked position such that the each of the dispensing body's key members 530 is vertically blocked by a keyed slot's second portion 386.

In the preferred embodiment, the housing 540 is a generally cylindrical structure having a top 542 and an outer diameter 544, and comprises a throat 550, a chamber 560, a shelf 564, a dispense opening 566, and a gas input portion 570. The throat 550 comprises a cylindrical channel within the housing 540 that extends from the central opening 504 of the base 502 to the shelf 564. The throat 550 preferably has a diameter 552 equal to the inner diameter 306 of the body receiver's fluid transfer tube 302. The chamber 560 comprises a cylindrical opening inside the housing 540, extending from the shelf 564 to the top 542 of the housing 540. The chamber 560 has a diameter 562 that is larger than the diameter 552 of the throat 546.

The dispense opening 566 comprises a circular opening in the housing 540 through which fluid that has entered the chamber 560 from the throat 550 is selectively routed out of the housing 540. Those skilled in the art will recognize that fluid from an external source would be routed into the chamber 560 via the dispense opening 566 in the event that the dispense head assembly 100 is used for fluid return. In the preferred embodiment, the dispense opening 566 is positioned slightly above the shelf 564, and has a diameter 568 equal to that of the throat 546.

The gas input portion 570 comprises an opening 572 that forms the beginning of a hollow pathway 574 within the housing 540. The hollow pathway 574 leads to the opening 514 on the ceiling 512 of the dispensing body's base 502. Via the gas input portion 570, a blanket gas such as Nitrogen can be routed from the dispensing body 500 into the body receiver 300 and into the drum 20. Finally, the threaded rim 580 comprises a lip or rim proximate the top 542 of the housing 540, having supportive buttress threads for screwing the cap 600 onto the dispensing body 500.

Cap

Figure 7:
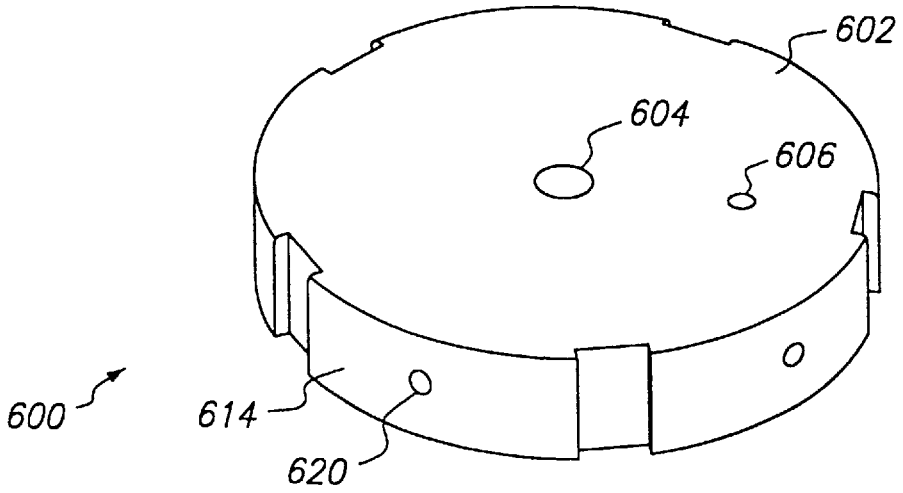
FIG. 7 is a top perspective view of a cap of the present invention.

Referring also now to FIG. 7, a top perspective view showing a preferred embodiment of the cap 600 of the present invention is shown. The cap 600 comprises a generally-circular lid that screws onto the dispensing body 500, and includes a top side 602 having a central opening 604 and a detector opening 606; an underside 608; and a perimeter body 610 having an interior 612 and an exterior 614. Supportive buttress threads reside upon the interior 612, to facilitate screw-wise attachment of the cap 600 to the dispensing body 500 in a conventional manner.

The perimeter body's exterior 614 includes a plurality of lock openings 620, each of which is sized to receive the wrench handle's lock pin 440. The cap 600 is screwed tightly onto the dispensing body 500 to a final tightened position. In the preferred embodiment, the final tightened position is such that when the wrench handle 430 is raised from a position that is generally parallel to the wrench head 402 to an upright or generally perpendicular position, the lock pin 440 moves into one of the cap's lock openings 620.

The central opening 604 on the cap's top side 602 is preferably sized to receive an actuator rod 730 that forms a portion of the spring-based plunger unit 700, such that the actuator rod 730 can move up and down relative to the dispensing body 500. The cap's detector opening 606 is sized to receive a conventional leak detector, such as a Sun-X model FX11J amplifier coupled to model FDEG1 optic cable (Sun-X Corporation, Nagoya, Japan). Those skilled in the art will recognize that the use of a leak detector is not required, and thus an alternate embodiment could exclude the detector opening 606.

Spring-Based Plunger Unit

Figure 8:
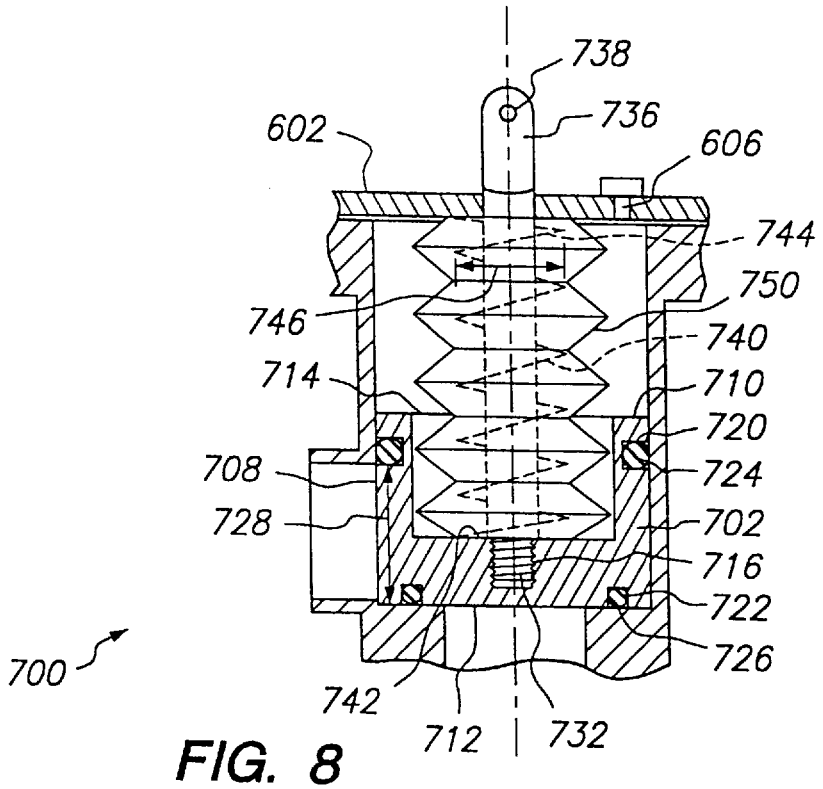
FIG. 8 is a cross-sectional view of a preferred embodiment of a spring-based plunger unit of the present invention.

The spring-based plunger unit 700, under control of the lever-lock handle 800, controls the flow of fluid through the dispensing body 500 via a piston that selectively blocks the housing's dispense opening 566. Referring also now to FIG. 8, a side view of a preferred embodiment of the spring-based plunger unit 700 is shown. The spring-based plunger unit 700 comprises a piston body 702, an actuator rod 730, a spring 740, and a bellows 750. The piston body 702 comprises a cylindrical disk or wafer characterized by a diameter 706, and having an outer surface 708; a top and a bottom surface 710, 712; a central recess 714; and a first and a second o-ring groove 720, 722 in which a first and second o-ring 724, 726 respectively reside. The piston body's diameter 706 is preferably slightly less than the diameter 562 of the dispensing body's chamber 560.

The first o-ring groove 720 comprises a channel or recess that encircles the piston body's outer surface 708, and is preferably located near the piston body's top surface 710. The first o-ring 724 extends slightly beyond the piston body's diameter 706, such that insertion of the spring-based plunger unit 700 into the dispensing body's chamber 560 results in a leakproof seal between the chamber 560 and the piston body 702, while allowing the piston body 702 to move vertically in the chamber 560 in response to an applied force. The distance between the bottom surface 712 of the piston body 702 and the point at which the first o-ring groove 720 begins is defined herein as a seal length 728. In the present invention, the seal length 728 is greater than the distance between the dispensing body's shelf 562 and the portion of the dispense opening 566 that is closest to the dispensing body's threaded rim 580. Thus, the first o-ring 724 remains above the dispense opening 566 at all times when the piston body 702 is within the chamber 560.

The second o-ring groove 722 comprises a circular channel in the piston body's bottom surface 712, and is larger than the diameter 552 of the housing's throat 550. When the piston body 702 is compressed against the shelf 564, the second o-ring 726 ensures a leakproof seal between the piston body 702 and the throat 550.

The central recess 714 comprises a channel extending from the piston body's top surface 710 toward, but not reaching, the bottom surface 712. The central recess 714 includes a threaded terminal portion 716. The central opening 714 is designed to receive the actuator rod 730, which comprises a rod having a threaded end 732; and a coupling portion 736 having an opening 738. The threaded end 732 of the actuator rod 730 screws into the terminal portion 716 of the central recess 714. In the present invention, the length of the actuator rod 730 is such that when the piston body 702 is compressed against the dispensing body's shelf 562, the coupling portion 736 extends beyond the cap's top side 602.

The spring 740 comprises a conventional coil for storing mechanical energy, and includes a bottom end 742, a top end 744, and an outer diameter 746. The bottom end 742 of the spring 740 abuts the bottom of the piston body's central recess 714, while the spring's top end 744 abuts the underside 610 of the cap 600. The energy stored in the spring 740 continually forces the piston body 702 toward the dispensing body's shelf 562. The force supplied by the spring 740 can be selectively overcome via the lever-lock handle 800 acting upon the actuator rod 730 to switch the dispense head assembly from an off state to an on state, as described in detail below. In an exemplary embodiment, the spring 740 is a McMaster-Carr model number 9434K148, which is made of type 316 stainless steel and has a length of 2.0 inches and an outer diameter of 0.75 inches.

The bellows 750 comprises a flexible sheath or casing surrounding the spring 740. Preferably, the bellows 750 is present when the dispense head assembly 100 is used in chemical environments capable of attacking the spring 740. In an exemplary embodiment, the bellows 750 comprises Convoflex tubing (Furon Corporation, Anaheim, Calif.).

Lever-Lock Handle

Figure 9:
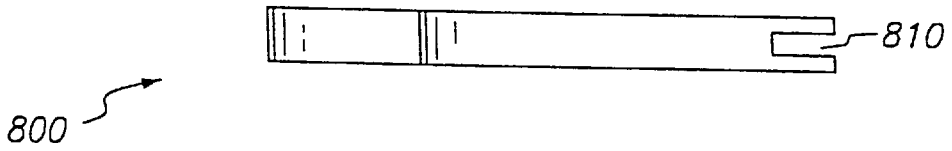
FIG. 9 is a top view of a preferred embodiment of a lever-lock handle of the present invention.

Referring also now to FIG. 9, a top view showing a preferred embodiment of the lever-lock handle 800 is shown. The lever-lock handle 800 is generally L-shaped, and comprises a coupling portion 802 and a handle portion 820. The coupling portion 802 includes a top side 802, an end 804, and an underside 806. The coupling portion 802 comprises a slot 810; a hinge pin 814; and a support recess 816. The slot 810 is positioned proximate the end 804 of the coupling portion 802, and includes a transverse opening 812. The slot 810 is designed to receive the actuator rod's coupling portion 736, to an extent that facilitates alignment of the opening 738 on the actuator rod's coupling portion 736 with the transverse opening 812. The hinge pin 814 couples the lever lock handle 800 to the actuator rod 730 via the aforementioned aligned openings 738, 812. The coupling portion's support recess 816 is designed to receive the curved end 468 of the wrench handle's support stub 466.

The handle portion 820 comprises an arm 822 upon which a hand grip 824 resides. The arm 822 preferably has a width that is slightly less than that of the wrench handle's recessed slot 450, but slightly larger than the distance between the lock lips 458 on the wrench handle's slot guides 454, 456. The hand grip 824 preferably comprises a generally-rectangular loop having an opening designed to receive a person's fingers.

When the wrench handle 430 is in a generally perpendicular position relative to the wrench head 402, a person can utilize the hand grip 824 to raise or lower the spring-based plunger unit's actuator rod 730, thereby controlling the position of the piston body 702 within the dispensing body's chamber 560.

Fluid Flow Control

The flow of fluid through the dispensing body 500 is controlled by the position of the piston body 702 within the dispensing body's chamber 560. The position of the piston body 702 is selectively controlled by the lever-lock handle 800 acting upon the spring 740.

When the piston body 702 is against the dispense body's shelf 562, the spring 740 is characterized by a first compressed length. The energy stored in the spring 740 at the first compressed length is sufficient to tightly compress the piston body 702 against the shelf 562, thereby maintaining a leakproof seal between the piston body 702 and the dispense body's throat 550. Thus, when the spring 740 is at its first compressed length, fluid flow is prevented and the dispense head assembly is in a "fully off" or no-flow state.

In the preferred embodiment, when the lever-lock handle 800 is in a raised position such that its handle portion 820 is generally parallel to the wrench head's top surface 404 (i.e., generally perpendicular to the dispensing body's chamber 560), the spring 740 is at its first compressed length and no fluid flow occurs. As the lever-lock handle 800 is lowered toward the wrench head 402, the support recess 816 contacts the wrench handle's support stub 466. The support stub 466 braces the lever-lock handle 800 as it is lowered further. Thus, as the lever-lock handle 800 is lowered, the actuator rod 730 and piston body 702 are raised, and a compressive force is exerted upon the spring 740. A small amount of fluid flow begins as the piston body's second o-ring 726 is raised off of the dispensing body's shelf 762.

Figure 10:
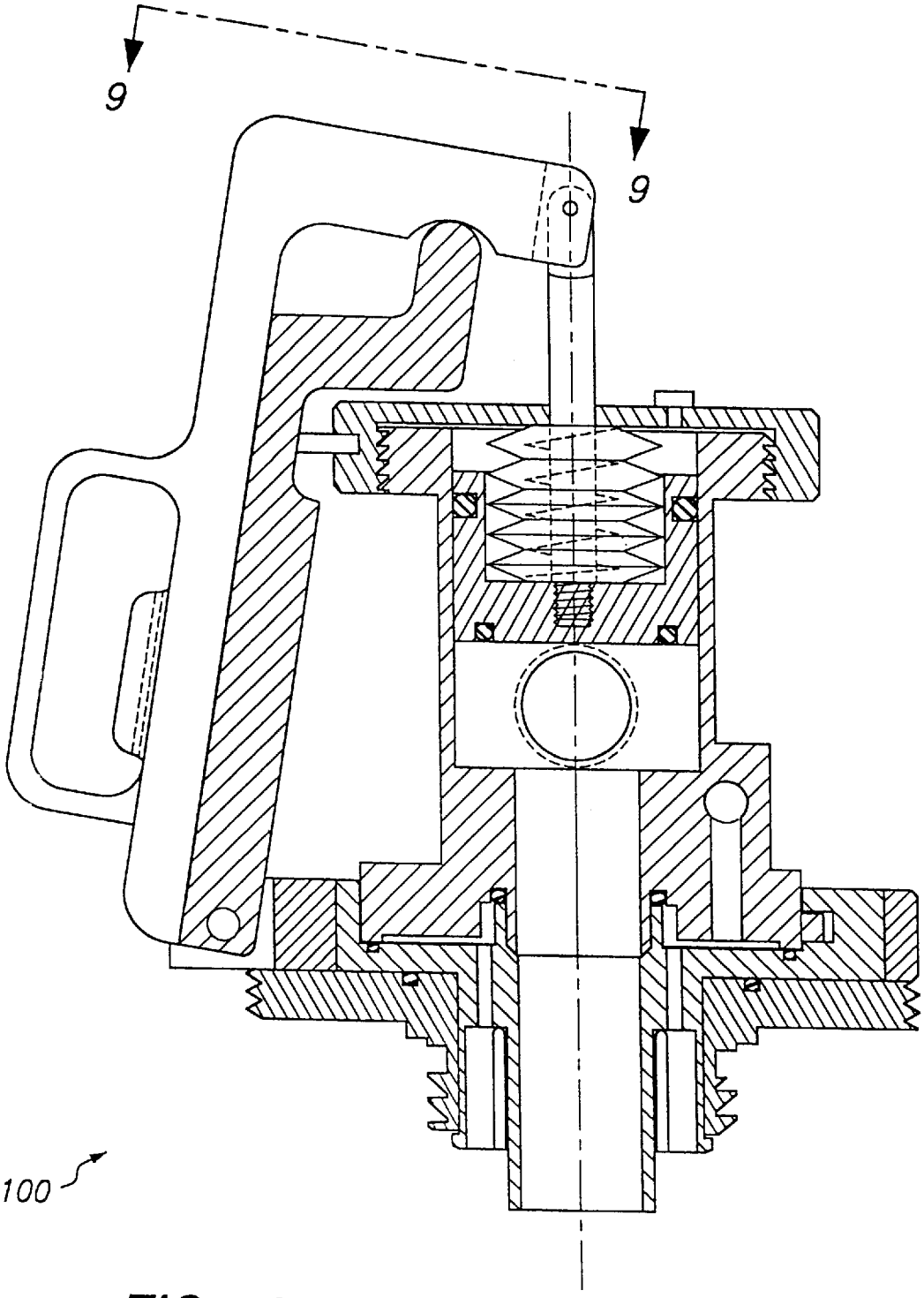
FIG. 10 is a cross-sectional view of a preferred embodiment of a dispense head assembly in a fully-on state.

Once the lever-lock handle 800 is lowered through the wrench handle's lock lips 458 and into the recessed slot 450, the spring 740 has been compressed to a second compressed length. At this point, the piston body's second o-ring 726 is preferably slightly above the dispense opening 566, and the dispense head assembly 100 is in a "fully-on" state at which maximum fluid flow can occur. Referring also now to FIG. 10, a cross-sectional view of the dispense head assembly 100 in a fully-on state is shown.

In the preferred embodiment, the spring 740 is chosen such that its stored energy while at the second compressed length is insufficient to release the lever-lock handle 800 from its locked position in the wrench handle's slot 450. Turning the dispense head assembly from the fully-on state to the fully-off state occurs by applying a force sufficient to release the lever-lock handle 800 from the wrench handle's recessed slot 450, and raising the lever-lock handle 800 to the point at which the spring 740 is at its first compressed length. Those skilled in the art will recognize that the spring 740 will automatically raise the lever-lock handle 800 once it has been released from the wrench handle 430, until the first compressed length is reached.

Safety Cover

When the lever-lock handle 800 is raised such that its handle portion 820 is generally parallel to the wrench head's top surface 404, the wrench handle 430 can be lowered to a position that is generally parallel with the wrench head 402. As the wrench handle 430 is lowered, its lock pin 440 exits the lock opening 620 on the cap 600 with which it was aligned. The dispensing body 500 can then be removed or decoupled from the body receiver 300. The present invention provides for a safety cover 900 to ensure that fluid is contained within the drum 20 when the dispensing body 500 has been separated from the body receiver 300. The safety cover 900 is particularly useful when the drum 20 is transported.

Figure 11:
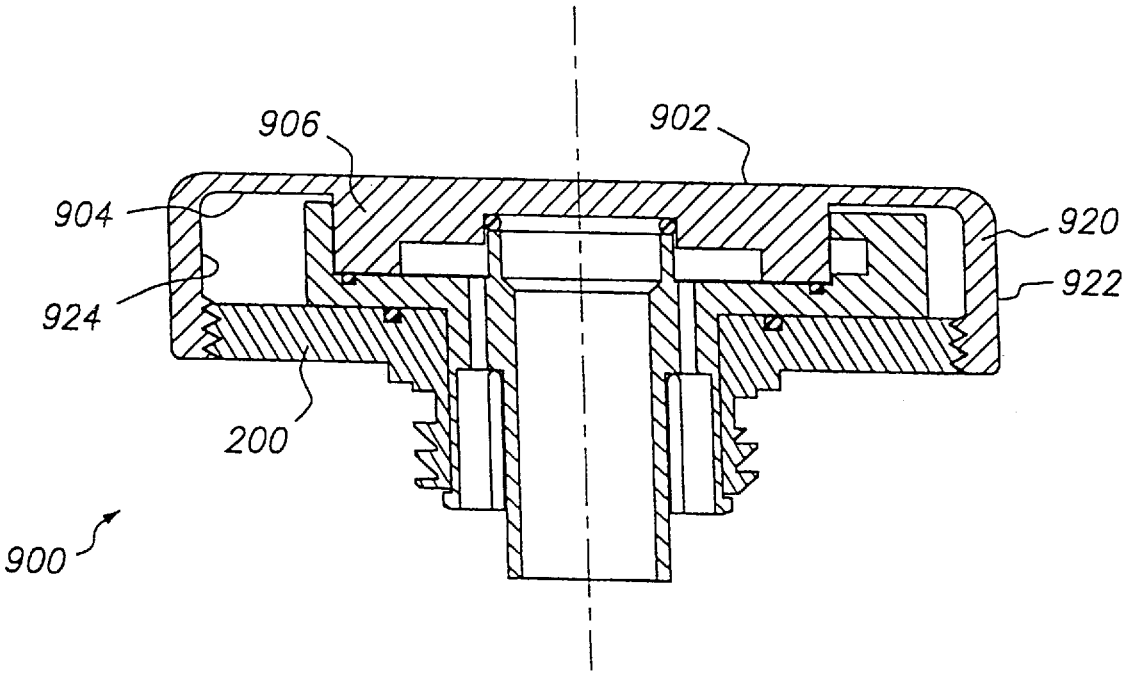
FIG. 11 is a cross-sectional view of a safety cover of the present invention.

Referring now to FIG. 11, a cross-sectional view showing a preferred embodiment of the safety cover 900 is shown. The safety cover 900 comprises a lid that screws onto the bung adapter 200 to provide a leakproof seal with the body receiver 300. The safety cover 900 includes a top surface 902; an underside 904 having a tiered sealing ring 906; and a perimeter body 920 having an exterior 922 and an interior 924. The interior 924 comprises buttress threads, for screwing onto the bung adapter's threaded platform 230. A first portion of the tiered sealing ring 906 comprises a circular ring extending downward from the safety cover's underside 904, which is sized to fit against the o-ring 380 within the recessed coupling tray's o-ring groove 378. Thus, as the safety cover 900 is screwed onto the bung adapter 200, the sealing ring 906 abuts and compresses the coupling tray's o-ring 380 to provide a leakproof seal. A second portion of the sealing ring 906 comprises a recessed disk having an o-ring groove 908 and an accompanying o-ring 910, which are sized to form a leakproof seal against the body receiver's seating collar 368.

Exemplary Dimensions and Construction

A complete set of drawings showing exemplary dimensions for constructing the dispense head assembly 100 is shown in Appendix A to the application as originally filed. Those skilled in the art will recognize that the one or more dimensions given in Appendix A can be modified according to the manners in which the dispense head assembly 100 will be used. In the preferred embodiment, each of the bung adapter 200, the body receiver 300, the dispensing body 500, and the cap 600 is preferably manufactured or machined from a single piece of material. In a first exemplary embodiment, the dispense head assembly 100 is constructed of type 316 stainless steel. In a second exemplary embodiment, the dispense head assembly 100 is constructed using polypropylene. The present invention can be manufactured using conventional techniques, such as machining from raw materials, machining from forged blocks, or injection molding.

Alternate Embodiment

Figure 12:
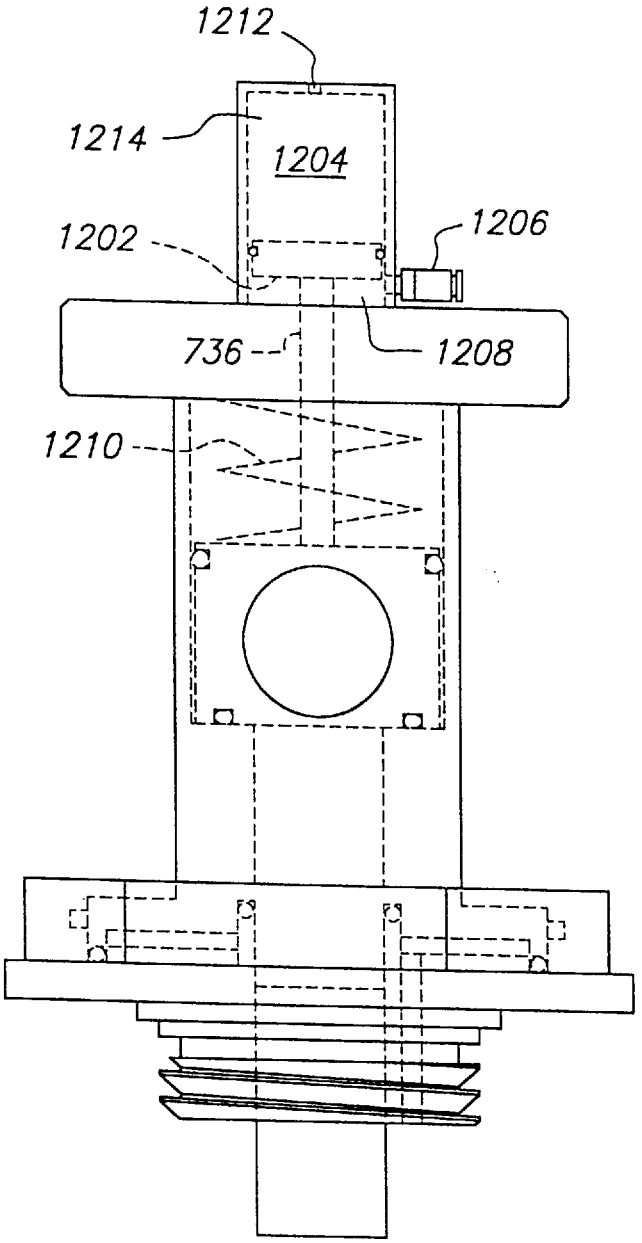
FIG. 12 is a side view of an alternate embodiment of a dispense head assembly constructed in accordance with the present invention.

Referring now to FIG. 12, a side view of an alternate embodiment of a dispense head assembly 110 constructed in accordance with the present invention is shown. In the alternate embodiment, the actuator rod 736 is coupled to a conventional solenoid-driven pneumatic piston, and the lever-lock handle 800 is not present. This facilitates completely automatic fluid flow control in a manner that will be understood by those skilled in the art.

Preferred Deployment

In the present invention, bung adapters 200 are preferably inserted into a drum 20 at a chemical manufacturing or supply facility. A first and a second body receiver 300 are orbitally welded to a sump dip tube 30 and a return dip tube 32. Each body receiver 300/dip tube 30, 32 unit is inserted into a bung adapter 200 on the drum 20 after the drum 20 has been filled. The safety cover 900 is then screwed on, and the drum 20 is ready for shipment.

Once the drum 20 arrives at its designated dispensing location, the safety cover 900 is removed, and the wrench safety handle 400 is fitted to the body receiver 300. The dispensing body 500, with the cap 600 covering the spring-based plunger unit 700 and the lever-lock handle 800 attached to the actuator rod 736, is inserted into the body receiver 300 via key alignment followed by a partial rotation to vertically lock the dispensing body 500 in place. After the wrench handle 432 is raised and the lock pin 440 inserted into the cap 600, the present invention can be placed in the "fully-on" state by locking the lever-lock handle 800 into the wrench handle 432.

Switching to the "fully-off" state simply requires releasing the lever-lock handle 800. Decoupling the dispensing body 500 from the body receiver 300 simply requires lowering the wrench handle 432, then a twist to free the keys, and a vertical lift applied to the dispensing body 500. The present invention thus facilitates simple, rapid coupling and decoupling from one drum 20 to another.

In the present invention, each of the dip tube 30, 32, the body receiver's fluid transfer tube 302, and the dispensing body's throat 550 have an identical inner diameter. Thus, the dip tube 30, 32, the fluid transfer tube 302, and the throat 550 taken together form a single, unobstructed, uniform-diameter flowpath between the drum 20 and the chamber 560. In the preferred embodiment, the diameter of this single, unobstructed flowpath is 1 inch. The design of the present invention contrasts sharply with the prior art, which smaller-diameter flowpaths and/or flowpath obstructions.

While the present invention has been described with reference to particular embodiments, those skilled in the art will recognize that various modifications can be provided. For example, the dispensing body's key members 530, as well as the keyed slots 382 within the body receiver's recessed coupling tray 360, could be arranged in a different pattern and/or one or more different sizes. Such a modification could be useful to differentiate dispense head assemblies 100 according to particular chemical environments. The description herein provides for these and other variations upon the present invention, which is limited only by the following claims.

What is claimed is:

1. A dispense head assembly for selectively controlling the flow of fluid between a drum and a fluid distribution pathway, the dispense head assembly comprising:

a fluid flowpath coupled to exchange fluid with the drum, the fluid flowpath characterized by a first diameter;

a chamber coupled to the fluid flowpath, the chamber having a dispense opening, the chamber characterized by a second diameter;

a plunger that is movable within the chamber to slectively block fluid flow between the fluid flowpath and the dispense opening;

a cap coupled to the chamber, the cap having an opening;

an actuator rod having a first end coupled to the plunger and a second end protruding through the opening on the cap; and a handle coupled to the actuator rod's second end.

2. The apparatus of claim 1, wherein only a single fluid flowpath is present.

3. The apparatus of claim 1, wherein the fluid flowpath is unobstructed.

4. The apparatus of claim 1, wherein the second diameter is at least as large as the first diameter.

5. The apparatus of claim 1, wherein the dispense opening is at least as large as the first diameter.

6. The apparatus of claim 1, further comprising a spring, the spring having a first end coupled to the plunger and a second end coupled to the cap.

7. The apparatus of claim 6, wherein the spring forces the plunger to block the fluid flowpath when the handle is in a first position.

8. The apparatus of claim 7, wherein the plunger also blocks the dispensing opening when the handle is in the first position.

9. The apparatus of claim 7, wherein movement of the handle to a second position compresses the spring and moves the plunger such that fluid can flow between the dispense opening and the fluid flowpath.

10. The apparatus of claim 6, further comprising a leverage post against which the handle is raised and lowered.

11. The apparatus of claim 1, further comprising a solenoid coupled to the plunger.

12. A dispense head assembly for selectively controlling the flow of fluid between a drum and a fluid distribution pathway, the dispense head assembly comprising:

a bung adapter, for insertion into the drum, the bung adapter having a central opening;

a body receiver, for selective insertion into the bung adapter, the body receiver including a tray having a central opening and a set of keyed slots, a fluid transfer tube extending from the central opening, and a fin spring surrounding a portion of the fluid transfer tube; and a dispensing body, for selective insertion into the body receiver.

13. The apparatus of claim 12, wherein the fin spring vertically locks the body receiver into the bung adapter while allowing the body receiver to have freedom of rotational movement.

14. The apparatus of claim 12, further comprising a dip tube coupled to the fluid transfer tube.

15. A dispense head assembly for selectively controlling the flow of fluid between drum and a fluid distribution pathway, the dispense head assembly comprising:

a bung adapter, for insertion into the drum, the bung adapter having a central opening;

a body receiver, for selective insertion into the bung adapter; and a dispensing body, for selective insertion into the body receiver, said dispensing body including a throat, a dispense opining, a piston capable of selectively blocking fluid flow between the throat and the dispense opening, and a base portion having a set of key members.

16. The apparatus of claim 15, wherein the piston is coupled to one from a group of handle and a solenoid.

* * * * *